United States Patent [19]

Joly

[11] Patent Number: 4,477,131

[45] Date of Patent: Oct. 16, 1984

[54] ELECTRIC DISTRIBUTION BOARD

[75] Inventor: Jean Joly, Houilles, France

[73] Assignee: La Telemecanique Electrique, France

[21] Appl. No.: 152,065

[22] Filed: May 20, 1980

[30] Foreign Application Priority Data

May 21, 1979 [FR] France ..... 79 13713

[51] Int. Cl.[3] ..... H01R 4/66; H01R 13/506

[52] U.S. Cl. ..... 339/14 R; 339/23; 339/98

[58] Field of Search ..... 339/22 R, 23, 14 L, 339/97 R, 97 P, 98; 174/48, 49

[56] References Cited

U.S. PATENT DOCUMENTS 3,786,171 1/1974 Shira ..... 174/48

4,278,834 7/1981 Boundy ..... 339/22 R X

FOREIGN PATENT DOCUMENTS 1413939 9/1965 France ..... 174/48

577049 5/1946 United Kingdom ..... 339/23

1186271 4/1970 United Kingdom ..... 339/23

*Primary Examiner*—Eugene F. Desmond

*Attorney, Agent, or Firm*—William A. Drucker

[57] ABSTRACT

An electric distribution board serves for the distribution of two phases, or of two phases and an earth and has a back member which receives, according to choice, two mounts which are each appropriate to the respective method of current distribution, these mounts comprising selector means which only permit couplings with compatible current connector plugs.

8 Claims, 10 Drawing Figures

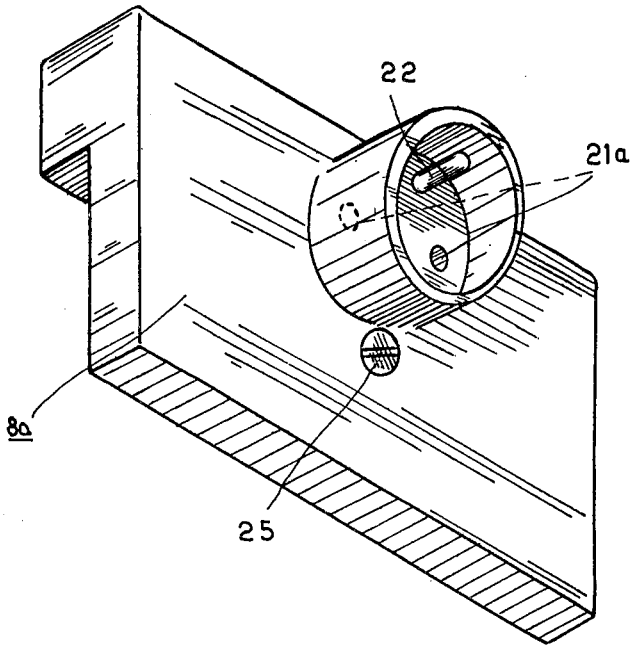
Fig. 5
Fig. 6
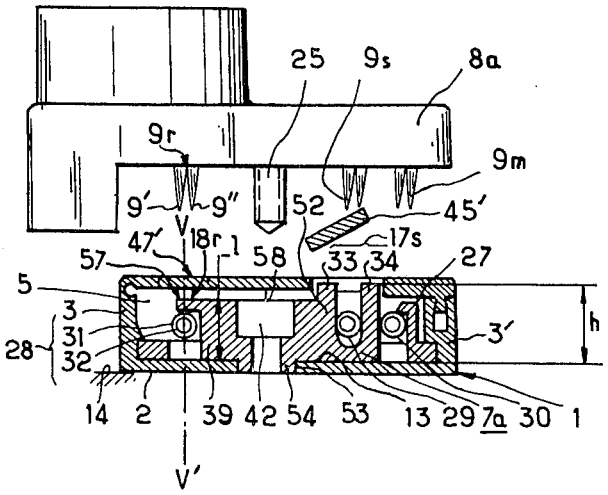

Fig. 7
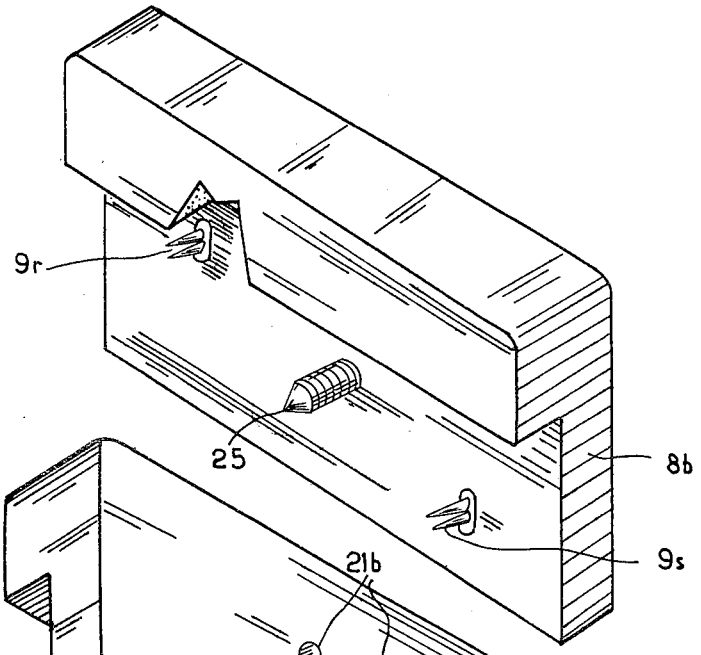
Fig. 8
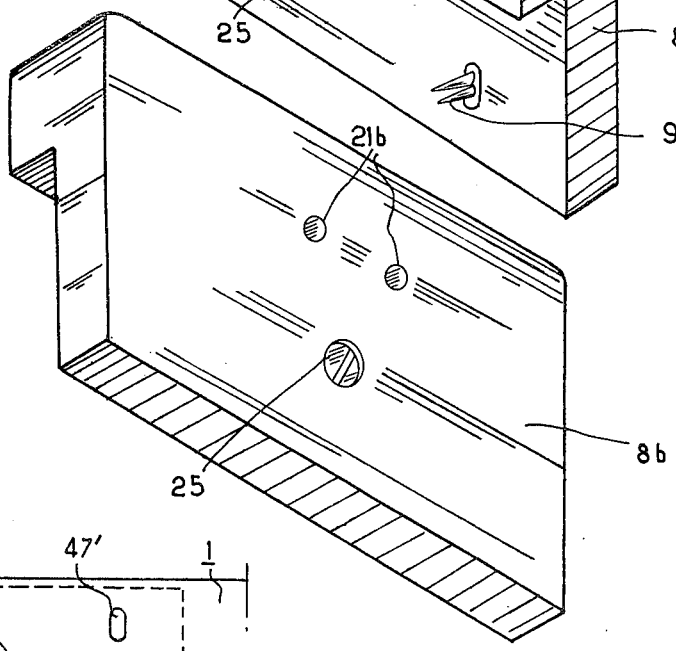
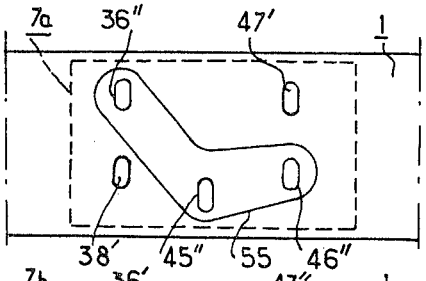
Fig. 9
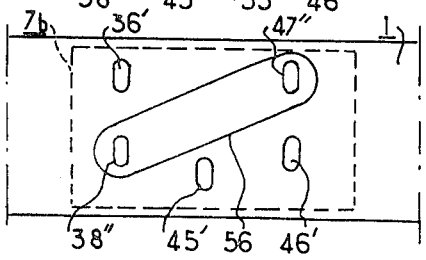
Fig. 10

ELECTRIC DISTRIBUTION BOARD

BACKGROUND OF THE INVENTION

The invention relates to an insulating electrical distribution board for the distribution of current having a back member or support shaped in the form of a "U" and having a free edge adapted to engage with a cover, and for forming a raceway and adapted to accommodate longitudinally disposed conductors and conductor positioning and retaining means, hereinafter called distribution mounts, said raceway receiving removable current feed plugs placed externally of the cover and coupled to the mounts by coupling means passing through openings of the cover, the said mounts being of a first type for the distribution of current taken between two phases and including an earthling line, or of a second type solely for distributionn of current taken between two phases, so as to cooperate with plugs comprising, or not, an earthing line.

These electrical boards, intended principally for domestic installations for the distribution of current, are generally manufactured starting from a shaped member of extruded plastic material and comprising only longitudinal parallel surfaces to the exclusion of any perforations or transverse stop surfaces. For the mounting of the mounts refered to above it is thus necessary to provide on these shaped members, at intervals corresponding to the selected spacing, some series of centering elements adapted to position the said mounts with precision, and to dispose properly with respect to them the apertures through which the coupling elements will pass; such a precuation is difficult to observe if the cover and the support are separate one from the other.

Furthermore, it is necessary to take steps to make it impossible to insert a plug intended for a mount of the first type on a mount of the second type, and inversely, with the aid of selector means which do not require a particular attention from the installer and the user.

The invention accordingly proposes to deal with these requirements with the aid of simple arrangements and a small number of items.

According to the invention, this result is obtained by the combination of the following features, certain of which are already known:

the cover is fixed on the support by means of a permanent hinge, during a simultaneous punching of the support, adapted to be placed on a wall, and of the cover, there are formed on the support a first series of apertures and on the cover a second series of perforations comprising useful perforations and forbidden perforations;

the portions of material punched in the cover are put back into position in the second series of perforations after the punching operation, and mounts of a first type and of a second type, have centering means adapted to cooperate with apertures of the first series, and first selector means which will face useful perforations of the second series, in order to push out therefrom the corresponding cut out portions, and second selector means which will be placed in the vicinity of forbidden perforations of the second series in order to support the corresponding cut out portions and avoid that the latter may be pushed out of the said forbidden perforations when the cover is closed.

BRIEF DESCRIPTION OF THE DRAWINGS

Other features of the invention, will be apparent from the following description with reference to the accompanying drawings, wherein:

FIGS. 4 and 5 are views in perspective respectively of a first current supply plug capable of being associated with a first type of mount;

FIG. 6 is a view in section of a mount illustrated in FIG. 2, taken on the stepped plane UU';

FIGS. 7 and 8 are two views in perspective of a second current supply plug capable of being associated with a second type of mount, and FIGS. 9 and 10 show in elevation two external views of the board, the cover of which is closed again after placing in position of a mount of the first type or of the second type, respectively.

DESCRIPTION OF THE PREFERRED EMBODIMENT

Figure 1:
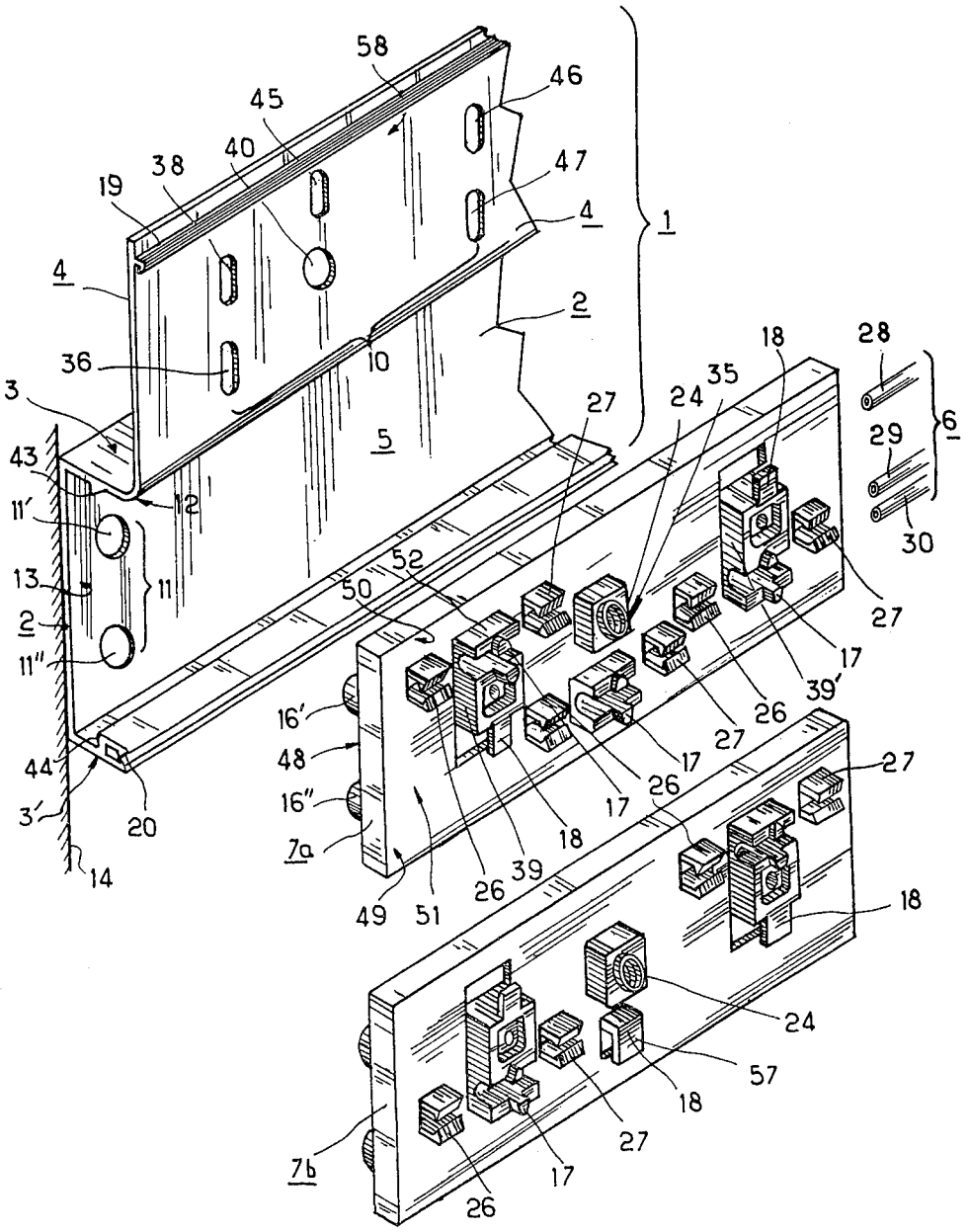
FIG. 1 is a perspective view of a portion of board and the two types of mounts which can be associated therewith.

An insulating electrical distribution board has a body 1 in FIG. 1 which comprises a back member 2 required to be placed and secured by any appropriate means against a wall 14, and which comprises for this purpose a back surface 13 provided with two longitudinal parallel flanges or wings 3,3' which give the back member the general cross-section of a "U".

At the connecting end portion of the flange 3 is provided a permanent longitudinal hinge 12 which attaches a pivoting cover 4.

This cover comprises at its free end, remote from the hinge, a hooking means 19 which cooperates, when the cover is closed, with a locking means 20 carried by the free edge of the flange 3'. A space 5 is thus comprised between the bottom wall and the flanges of the base, and is closed by the cover when the cover is lowered and fastened.

The body of the distribution board, which with more reduced dimensions can also take the form of a moulding, is obtained by extrusion of an appropriate plastics material, and the hinge 12 can be formed during this extrusion, either by the fact that its thickness is locally more reduced than that of the remainder of the body, or again by moulding on in the course of extrusion (or subsequently glueing on) an elastomeric strip (not shown) having suitable properties of flexibility.

When the process of extrusion is terminated, the body of the board is subjected to an operation of punching which can be carried out for example when the cover 4 is disposed, as is shown in FIG. 1, in a plane parallel to the plane of the bottom wall 13 of the base 2.

This operation of simultaneous punching has for its object to form locally on the body some series of perforations and apertures which are repeated regularly along the whole length of the moulding at predetermined intervals.

A first series of apertures 11, comprising those referenced as 11', 11'', is formed in the bottom wall 13 of the base 2, and a second series of perforations 10 comprising those referenced as 36, 38, 40, 45, 46, 47 is formed in the cover 4. These two series of perforations and apertures will be made simultaneously, and preferably with the same tool, in such a manner that their respective relative positionings are retained, irrespective of the region of the moulding in which they are formed.

The portions of material cut out in the second series of perforations 10 will be replaced therein, in such a manner as to close them up again; it is likewise possible to carry out only a partial punching through of the thickness of the material of the cover, and then force out those portions not yet separated.

One of the two insulating mounts shown in FIG. 1 respectively at *7a* and *7b* and carrying, on a back face 48 facing towards the back surface portion of the back member, centering elements 16', 16", will be disposed within the raceway in such a manner that these elements will enter the perforations 11', 11" in order to ensure a predetermined longitudinal position for the mount. The mount is then held by the longitudinal tenons 43, 44, disposed on the internal faces of the respective flanges 3,3', which bear against the edge portions 50, 49 of the mount remote from the face 48.

This mount furthermore comprises, on a front face 51 remote from the back member, first selector means, such as 17, (see FIGS. 1, 2 and 3), second selector means such as 18, (see FIGS. 1, 2, and 3), holding clips 26, 27 for the local retention of conductors such as 28, 29, 30 forming a part of a distribution network 6 which may have or not an earth conductor 30, and an opening 24 bored in a post and provided for example with a threading.

Figure 2:
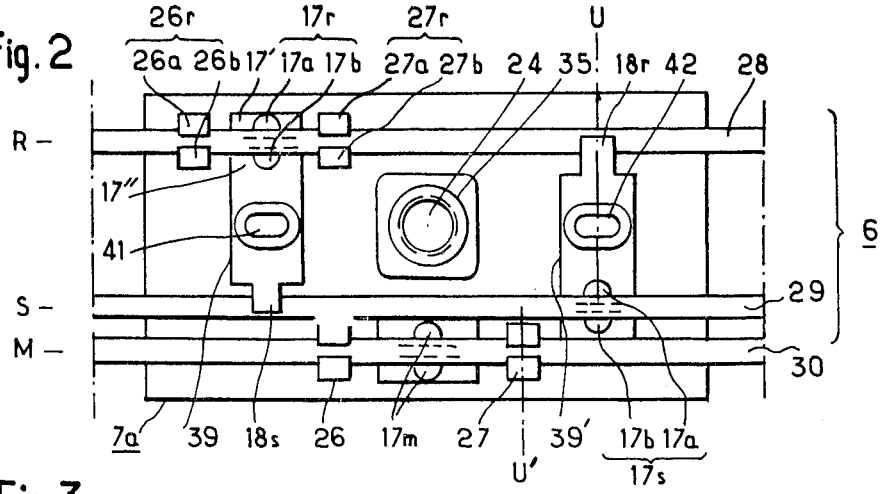
FIG. 2 and 3 are elevations respectively of a mount of each type.

In FIGS. 1 and 2 there will be seen at 6 the group of conductors comprising the conductors 28, 29, 30 which are placed parallel along the axes XX', YY', ZZ', in turn substantially parallel to the back surface and to the flanges of the back member 28 and 29 are, for example, the phase conductors R and S of the distribution network, while conductor 30 is the conductor M coupled to earth.

The conductor 28, see FIG. 2, cooperates with various items comprising (starting from the left-hand side of the figure): a first holding clip 26*r* having two arms 26*a*, 26*b*, a first selector means 17*r* having two projections 17*a*, 17*b*, a second clip 27*r* having two arms 27*a*, 27*b*, and a second selector means 18*r*. The shape of these items is best seen in FIG. 6.

Figure 4:
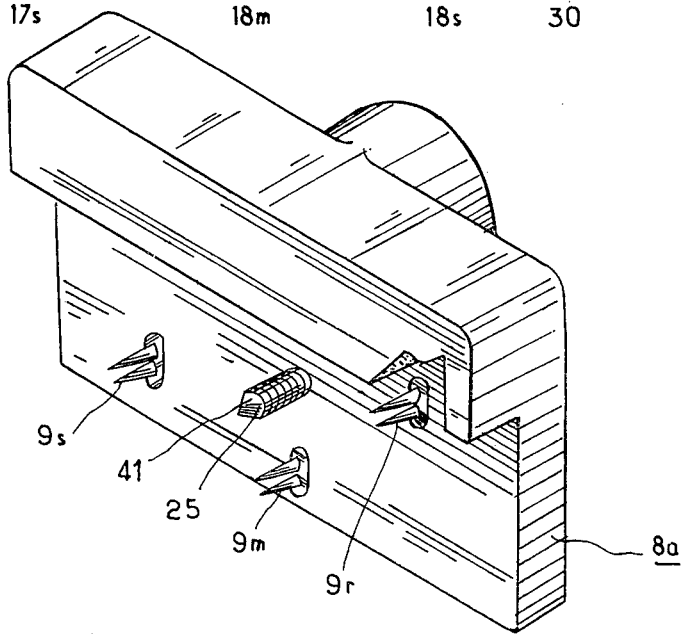

The clips 26 and 27 serve to support the conductor 28 in such a manner that the coupling pins such as 9*r*, 9*s*, 9*m*, visible in FIGS. 4, 6 and 7 and appertaining to current feed plugs such as 8*a* and 8*b*, can pass through its sheath 31 and enter into contact with its core 32, without causing a too pronounced flexing of the conductor. Furthermore, each of the selector means 17 has the shape of a fork 52 in order to receive the conductor which is associated therewith and comprises two arms 17', 17", having respective projections 17*a*, 17*b*, which are placed at one side and the other of the conductor at a distance from the latter such that they will permit the passage of two needles 9', 9", constituting the coupling pin concerned, for example 9*r*, and will also ensure their guiding, see FIGS. 2 and 6.

On FIG. 6, it will be seen that the ends 33, 34 of the arms of the fork 52 appertaining to 17*s* and bearing the projections 17*a*, 17*b* have, by reason of their height h, have passed through one of the perforations 46 of the second series of perforations 10 of the cover 4 when the latter, as shown in this figure, is in closed position, and moreover by pushing out the portion of material 45' which was occupying this perforation 45 before the closing down of the cover.

As apparent from FIG. 6, wherein it will be seen that the conductor 28 passes under a second selector means 18*r*, the upper support surface 57 of which is disposed at a height l such that when the cover 4 is closed the portion of material 47' which has been cut out in the cover, then put back into position, cannot be pushed out towards the interior of the space 5 of the board as a result of the proximity of surface 57 to the surface 58 of the cover. Portion 47', the upper surface of the selector means 18*r* and the conductor 28 are placed, in this zone, on a same straight transverse line VV', the selector means 18*r* is advantageously carried by a boss 39, 39' of the mount which is provided with an opening 42 which will receive, for example, a fastener serving to secure the board 1 on the wall 14.

The cover comprises another re-closed opening 40, see FIG. 1, which comes opposite to an annular rim 35 surrounding the opening 24 of the mount in order to permit this rim, when the cover 4 is closed, to push out the material occupying the aperture 40 and permit the end 41 of a fastener 25 of the current feed plug 8*a* or 8*b* to pass through it to make it fast to the mount, in order that electrical connections may be established between certain of the conductors 6 and certain needles forming the connector pins of the selected plug, see FIG. 4.

When the current-consuming apparatus requires connection to earth, a mount of the type 7*a* is placed in position in board 1 (see FIG. 2), and only a current feed plug of the type illustrated in FIGS. 4 and 5 may be associated therewith, by reason of the fact that the selector means 17*r*, 17*m* and 17*s* will have uncovered the useful apertures 55 placed opposite thereto, as can be seen at 36", 45" and 46" in FIG. 9.

The portions of material 47' and 38' which occupy the forbidden perforations 56, 47, 38 will not be able to be pushed out, by reason of the presence underneath them of the selector means 18*r* and 18*s*, and a current feed plug such as 8*b* will consequently not be able to be associated with the mount 7*a*.

Figure 3:
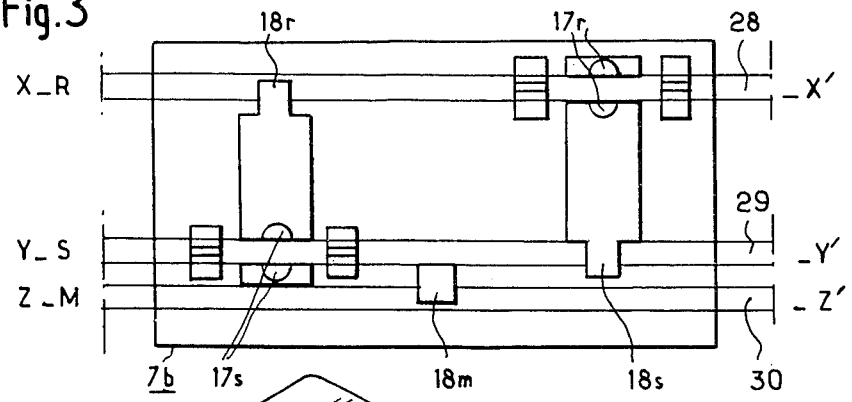

Conversely, when the current-consuming apparatus does not need earthing, the use of a mount such as 7*b*, seen in FIGS. 1 and 3, will cause the uncovering of two apertures 47", 38" and the supporting of these portions of material 36', 46', 45' (visible in FIG. 10) making it impossible for a current feed plug 8*a* to be fixed on the board. The useful perforations are now referenced as 56.

In known manner, the plug 8*a* comprises two current feed sockets 21*a* and a projecting earthing pin 22, and the plug 8*b* comprises only two current feed sockets 21*b*.

In FIG. 6 it will be seen that the aperture 42 is extended from the back face 48 of the mount by an annular portion 54 entering into an aperture 53 provided in the back surface 13 of the board. This annular portion form centering means having the same function as the members illustrated at 11', 11" and 16', 16" of FIG. 1. The threaded apertures 24 may have different diameters according to whether they are placed on mounts of a first or of a second type in order to prevent any attempt to insert an inappropriate plug.

I claim:

1. An electrical distribution device, comprising a surface mounting raceway having a back member adapted to be mounted on a wall and a front cover, said raceway being intended to accomodate electrical conductors, longitudinally arranged within the said raceway and each having a core and an insulating sheath, said conductors including two phase conductors and an earthing conductor, a plurality of conductor positioning and retaining units, lodged within the said raceway at predetermined positions along the length of said raceway and a plurality of current feed plugs having conductive pins adapted to pass through the conductor sheaths and to enter into contact with the conductor cores, said plugs being of a first type having a first arrangement of the said conductive pins which is adapted for feeding an electrical apparatus having an earth connection and of a second type having a second arrangement of the said conductive pins, which is adapted for feeding an electrical apparatus without any earth connection, said back member having a U-shaped cross-section with a flat back surface portion and first and second wing portions respectively having a free longitudinal edge and a connecting longitudinal end portion, a permanent hinge being formed at the said connecting longitudinal end portion for pivotally connecting the said cover to the said second wing portion of the back member, locking means at the said free edge for locking the cover in closed position, a first plurality of openings being formed in the said back surface and a second plurality of openings being formed in the said cover, the second plurality comprising a first group of openings arranged for receiving the conductive pins having the first arrangement and a second group of openings arranged for receiving the conductive pins having the second arrangement, the openings of the said first and second pluralities respectively having predetermined relative positions obtained by simultaneous punching of the said back surface and of the said cover to provide cut out portions and the openings of the second plurality being closed by said cut out portions of the cover which have been put back into the respective openings, each of said conductor positioning and retaining units comprising a support member having a flat back surface and a front surface, said flat back surface engaging the said flat back surface portion of the raceway and having centering projections which engage into the openings of the said first plurality, first and second pluralities of selector means being mounted on the said first face of each of the said conductor positioning and retaining units, said selector means being located along first, second and third generally parallel lines along which the two phase conductors and the earthing conductor are respectively positioned, the said selector means respectively facing openings of the said second plurality of openings when said cover is in closed position, the selector means of the first plurality each having projecting parts which pass through respective openings of the second plurality when the cover is in closed position and push out from the said respective opening the corresponding cut out portion, while the selector means of the second plurality each have a flat surface portion which cooperates with the cut out portion of the said respective opening of the second plurality for preventing the said cut out portion from being pushed out of the said respective opening when the cover is in closed position, the said conductor positioning and retaining units being of a first and a second types, the selector means of the first plurality of the conductor positioning and retaining units of the first type being positioned facing openings of the said first group and the selector means of the second plurality of the conductor positioning and retaining units of the first type being positioned facing openings of the said second group, while the selector means of the first plurality of the conductor positioning and retaining units of the second type are positioned facing the openings of the said second group and the selector means of the second plurality of the conductor positioning and retaining units of the second type are positioned facing the openings of the said first group.

2. An electrical distribution device according to claim 1, wherein each of the selector means of the first plurality comprises a fork, fast to the said front face of a conductor positioning and retaining unit, the respective conductor being inserted in said fork, said fork having two arms on which the said projecting parts are placed, and wherein the said flat surface portion of the selector means of the second plurality is located in close proximity to the internal surface of the cover.

3. An electrical distribution device according to claim 1, wherein at least two of the said conductors are supported in the vicinity of a selector means of the first plurality by at least one clip means and pass under at least one means of the second plurality, said clip means, selector means and conductors being substantially aligned.

4. An electrical distribution device according to claim 1, wherein projecting members fast on the said front face of the support member of each of the conductor positioning and retaining units are so shaped that each projecting member forms at least one selector means of the first plurality and one selector means of the second plurality, each of said projecting members further having an aperture and means for securing the conductor positioning and retaining unit and the back face to the back member to the wall, said securing means passing through the said aperture.

5. An electrical distribution device according to claim 4, wherein annular projecting members coaxially located around the said apertures on the back face of the support member of the conductor positioning and retaining units are part of the said centering projections.

6. An electrical distribution device according to claim 1, wherein each of the said wing portions of the back member has a longitudinal tenon which cooperates with the support member of the conductor positioning and retaining units to position the said support member in a transverse direction.

7. An electrical distribution device according to claim 1, wherein each of said plugs has a securing projecting member and a post, secured to the front face of each of said support members of the conductor positioning and retaining units, has a securing aperture which is located facing one of the openings of the said second plurality and an annular rim, located around said securing aperture, is adapted to pass through the said opening of the second plurality and push out the corresponding cut out portion therefrom when the cover is closed, while the said securing, projecting member will engage the said opening and the said securing aperture.

8. An electrical distribution device according to claim 1, wherein each of the conductor positioning and retaining units of the first type comprises three selector means of the first plurality and two selector means of the second plurality, whereas each of the conductor positioning and retaining means of the second type comprises two selector means of the first plurality and three selector means of second plurality, the cover comprising, opposite to each positioning and retaining means, three openings of the first group and two openings of the second group.

* * * * *